US010998126B2

(12) United States Patent
Nishikawa et al.

(10) Patent No.: US 10,998,126 B2
(45) Date of Patent: May 4, 2021

(54) COIL COMPONENT AND MANUFACTURING METHODS THEREOF

(71) Applicant: TDK CORPORATION, Tokyo (JP)

(72) Inventors: Tomonaga Nishikawa, Tokyo (JP); Tomokazu Ito, Tokyo (JP); Manabu Yamatani, Tokyo (JP); Masanori Suzuki, Tokyo (JP); Ikuya Kokubo, Tokyo (JP); Takuya Takeuchi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 224 days.

(21) Appl. No.: 16/000,669

(22) Filed: Jun. 5, 2018

(65) Prior Publication Data

US 2018/0358169 A1 Dec. 13, 2018

(30) Foreign Application Priority Data

Jun. 8, 2017 (JP) ..... 2017-113194

(51) Int. Cl.

| | |
|---|---|
| ***H01F 5/04*** | (2006.01) |
| ***H01F 27/29*** | (2006.01) |
| ***H01F 5/06*** | (2006.01) |
| ***H01F 41/12*** | (2006.01) |
| ***H01F 17/04*** | (2006.01) |
| ***H01F 17/00*** | (2006.01) |

(52) U.S. Cl.

CPC ..... *H01F 27/292* (2013.01); *H01F 5/04* (2013.01); *H01F 5/06* (2013.01); *H01F 17/0013* (2013.01); *H01F 17/04* (2013.01); *H01F 41/12* (2013.01); *H01F 2017/048* (2013.01)

(58) Field of Classification Search

CPC .... H01F 27/292; H01F 17/04; H01F 17/0013; H01F 5/06; H01F 5/04; H01F 41/12; H01F 2017/048; H01F 5/00; H01F 41/04

See application file for complete search history.

(56) References Cited

U.S. PATENT DOCUMENTS

| | | | | |
|---|---|---|---|---|
| 2008/0290977 | A1 | 11/2008 | Ito et al. | |
| 2009/0108958 | A1* | 4/2009 | Hadano | H03H 7/1758 333/175 |
| 2009/0121806 | A1 | 5/2009 | Sasaki et al. | |
| 2009/0134956 | A1 | 5/2009 | Hadano et al. | |
| 2013/0112466 | A1 | 5/2013 | Mori | |
| 2017/0110234 | A1 | 4/2017 | Nishikawa et al. | |

FOREIGN PATENT DOCUMENTS

| | | | |
|---|---|---|---|
| JP | 2005322743 | A | * 11/2005 |
| JP | 2008288505 | A | 11/2008 |
| JP | 2010-165975 | A | 7/2010 |
| JP | 2012238780 | A | 12/2012 |
| JP | 2017-50311 | A | 3/2017 |

* cited by examiner

*Primary Examiner* — Tuyen T Nguyen

(74) *Attorney, Agent, or Firm* — Young Law Firm, P.C.

(57) ABSTRACT

Disclosed herein is a coil component that includes: a coil part in which a plurality of conductor layers and a plurality of interlayer insulting layers are alternately laminated, the coil part having a mounting surface substantially parallel to the lamination direction and an upper surface substantially parallel to the lamination direction and positioned on an opposite side to the mounting surface; and a direction mark comprising a conductive material that covers a part of the conductor layers exposed on the upper surface.

16 Claims, 9 Drawing Sheets

COIL COMPONENT AND MANUFACTURING METHODS THEREOF

BACKGROUND OF THE INVENTION

Field of the Invention

The present invention relates to a coil component and a manufacturing method thereof and, more particularly, to a coil component provided with a direction mark and a manufacturing method thereof.

Description of Related Art

Among coil components, some are of a type in which characteristics thereof are changed depending on its mounting direction, and some are of a type in which characteristics thereof are not changed but influence that they exert on adjacent another chip component is changed depending on the mounting direction. In the coil components of the above types, a direction mark for specifying the mounting direction is provided according to circumstances.

There are known coil components described in JP 2008-288505 A and JP 2012-238780 A as coil components provided with the direction mark. The coil components described in JP 2008-288505 A and JP 2012-238780 A utilize part of a conductor pattern exposed on the side surface as the direction mark.

In the coil components described in JP 2008-288505 A and JP 2012-238780 A, the direction mark is formed on the side surface thereof, so that the direction mark cannot be confirmed in image recognition from the upper surface side. In order to solve such a problem, a method to form the direction mark on the upper surface of the coil component or to print the direction mark by laser irradiation onto the upper surface of the coil component can be considered. However, the above method involves not only an increase in the number of processes, but also difficulty in forming the direction mark for a coil component having a small planar size.

SUMMARY

It is therefore an object of the present invention to provide a coil component in which a direction mark can be formed on the upper surface thereof without involving an increase in the number of processes and a manufacturing method thereof.

A coil component according to the present invention includes: a coil part in which a plurality of conductor layers and a plurality of interlayer insulting layers are alternately laminated, the coil part having a mounting surface parallel to the lamination direction and an upper surface parallel to the lamination direction and positioned on an opposite side to the mounting surface; and a direction mark made of a conductive material that covers a part of the conductor layers exposed on the upper surface.

According to the present invention, part of the conductive layers is exposed on the upper surface, so that a conductive material that covers it can be utilized as the direction mark. This allows the direction mark to be easily confirmed by image recognition from the upper surface side. In addition, it is not necessary to form the direction mark by printing or laser irradiation, so that the number of processes is not increased.

It is preferable that the coil component according to the present invention further includes first and second external terminals that each cover part of the conductor layers different from that covered by the conductive material utilized as the direction mark, that the first and second external terminals are connected respectively to one end and the other end of a coil composed of the plurality of conductor layers, and that the direction mark and the first and second external terminals are made of the same conductive material. With this configuration, the direction mark can be formed simultaneously with the first and second external terminals.

In this case, the direction mark and the coil may be insulated from each other or may be electrically connected to each other. In the former case, a faulty short circuit through the direction mark can be prevented from occurring after mounting. In the latter case, formation of the direction make is facilitated.

The coil component according to the present invention may further include first and second magnetic layers disposed so as to sandwich the coil part in the lamination direction. With this configuration, higher inductance can be obtained.

A manufacturing method of a coil component according to the present invention includes: a first step of alternately laminating a plurality of conductor layers and a plurality of interlayer insulating layers, followed by dicing to expose one end and the other end of a coil composed of the plurality of conductive layers on the mounting surface parallel to the lamination direction and to expose a direction mark pattern composed of part of any of the plurality of conductive layers on the upper surface being parallel to the lamination direction and positioned on an opposite side to the mounting surface; and a second step of applying plating to the one end and the other end of the coil and the direction mark pattern to form first and second external terminals on the mounting surface and the direction mark on the upper surface.

According to the present invention, the direction mark can be formed on the upper surface without involving an increase in the number of processes.

In the present invention, the second step is performed preferably by forming the first and second external terminals and the direction mark at the same time by a barrel plating method. This allows the direction mark to be formed simultaneously with the formation of the first and second external terminals.

As described above, according to the present invention, the direction mark can be formed on the upper surface of the coil component without involving an increase in the number of processes.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
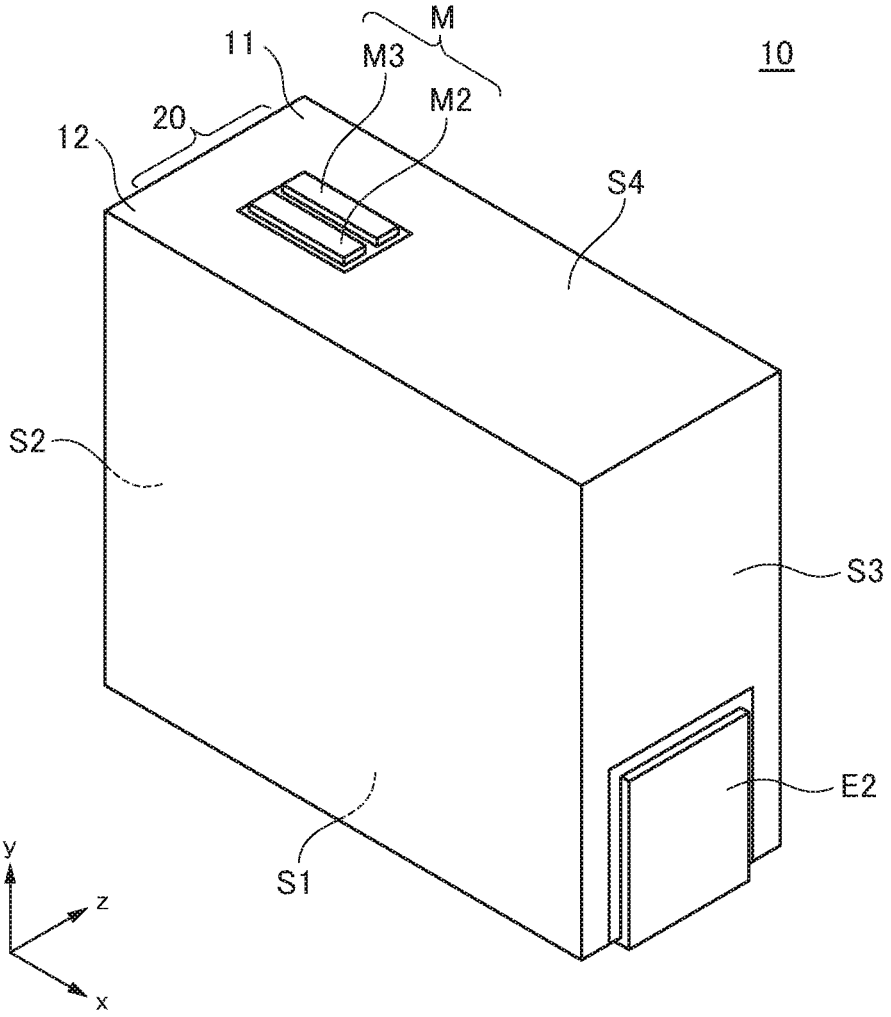
FIG. 1 is a perspective view illustrating a coil component according to a preferred embodiment of the present invention as viewed from an upper surface side.
Figure 2:
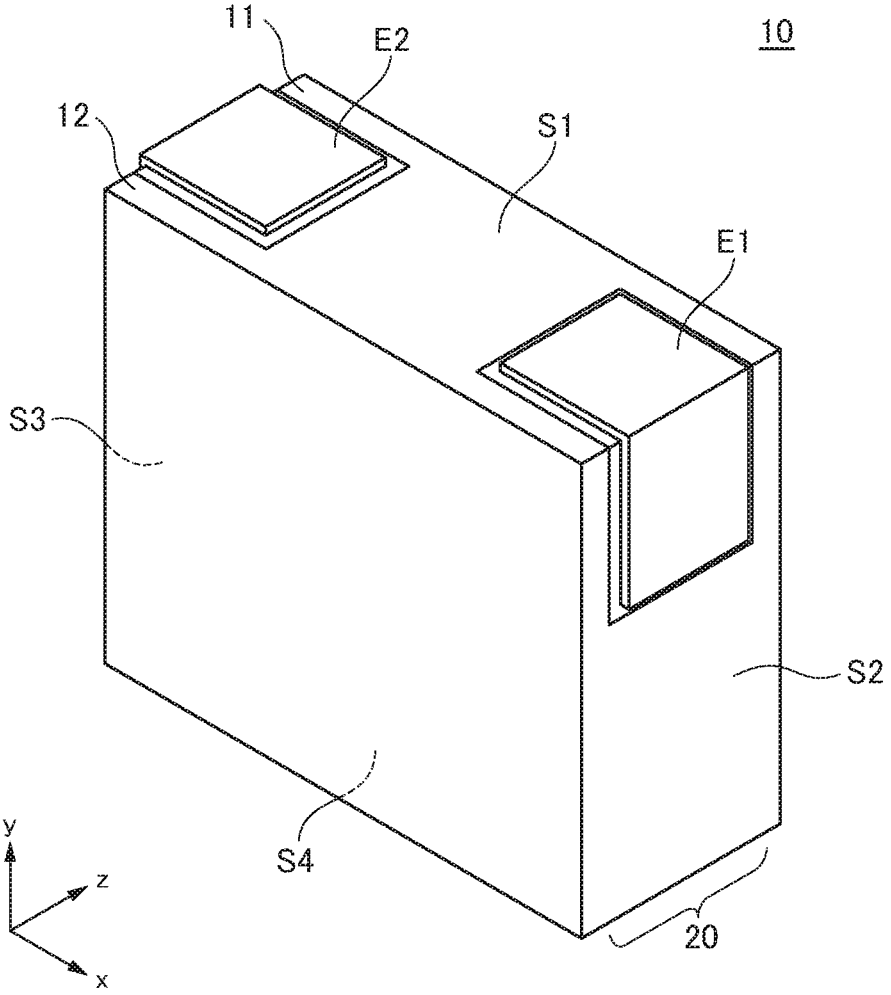
FIG. 2 is a perspective view illustrating the coil component according to the embodiment of the present invention as viewed from a mounting surface side.

FIGS. 1 and 2 are perspective views illustrating a coil component 10 according to a preferred embodiment of the present invention, where FIG. 1 is a diagram viewed from an upper surface side, and FIG. 2 is a diagram viewed from a mounting surface side.

The coil component 10 according to the present embodiment is a surface-mount type chip component suitably used as an inductor for a power supply circuit. As illustrated in FIG. 1, the coil component 10 has first and second magnetic layers 11 and 12 and a coil part 20 sandwiched between the first and second magnetic layers 11 and 12. Although the configuration of the coil part 20 will be described later, in the present embodiment, four conductor layers each having a coil conductor pattern are laminated to form one coil. One end of the coil is connected to a first external terminal E1 and the other end is connected to a second external terminal E2.

Each of the magnetic layers 11 and 12 is a resin composite material containing magnetic powder such as ferrite powder or metal magnetic powder and constitutes a magnetic path of magnetic flux generated by making a current flow in the coil. When the metal magnetic powder is used as the magnetic powder, a permalloy-based material is preferably used. As the resin, liquid or powder epoxy resin is preferably used. However, in the present invention, to constitute the magnetic layers 11 and 12 by the composite material is optional and, for example, a substrate made of a magnetic material such as sintered ferrite may be used as the magnetic layer 11.

Unlike commonly-used laminated coil components, the coil component 10 according to the present embodiment is vertically mounted such that the z-direction which is the lamination direction is parallel to a circuit board. Specifically, a surface S1 constituting the xz plane is used as amounting surface. On the mounting surface S1, the first and second external terminals E1 and E2 are provided. The first external terminal E1 is a terminal connected with one end of a coil formed in the coil part 20, and the second external terminal E2 is a terminal connected with the other end of the coil formed in the coil part 20.

As illustrated in FIG. 1, the first external terminal E1 is continuously formed from the mounting surface S1 to a side surface S2 constituting the yz plane, and the second external terminal E2 is continuously formed from the mounting surface S1 to a side surface S3 constituting the yz plane. Although details will be described later, each of the external terminals E1 and E2 is made of a laminated film of nickel (Ni) and tin (Sn) formed on the exposed surface of electrode patterns included in the coil part 20.

Further, the coil component 10 according to the present embodiment has a direction mark M exposed on an upper surface S4 constituting the xy plane and positioned on the opposite side to the mounting surface S1. In the example of FIG. 1, the direction mark M is constituted of direction marks M2 and M3 each made of the same conductive material as those of the external terminals E1 and E2. The x-direction position of the direction mark M is formed so as to be offset to the side surface S2 side, thereby making it possible to make a distinction between the external terminals E1 and E2 at mounting. The coil component 10 according to the present embodiment does not change its characteristics depending on its mounting direction; however, when the mounting direction is reversed, the direction of magnetic flux generated when a current is made to flow in the coil is reversed. Thus, influence that the coil component 10 exerts on adjacent another chip component may be changed depending on the mounting direction. For this reason, the coil component 10 has the direction mark M so as to specify the direction of magnetic flux in actual use.

Figure 3:
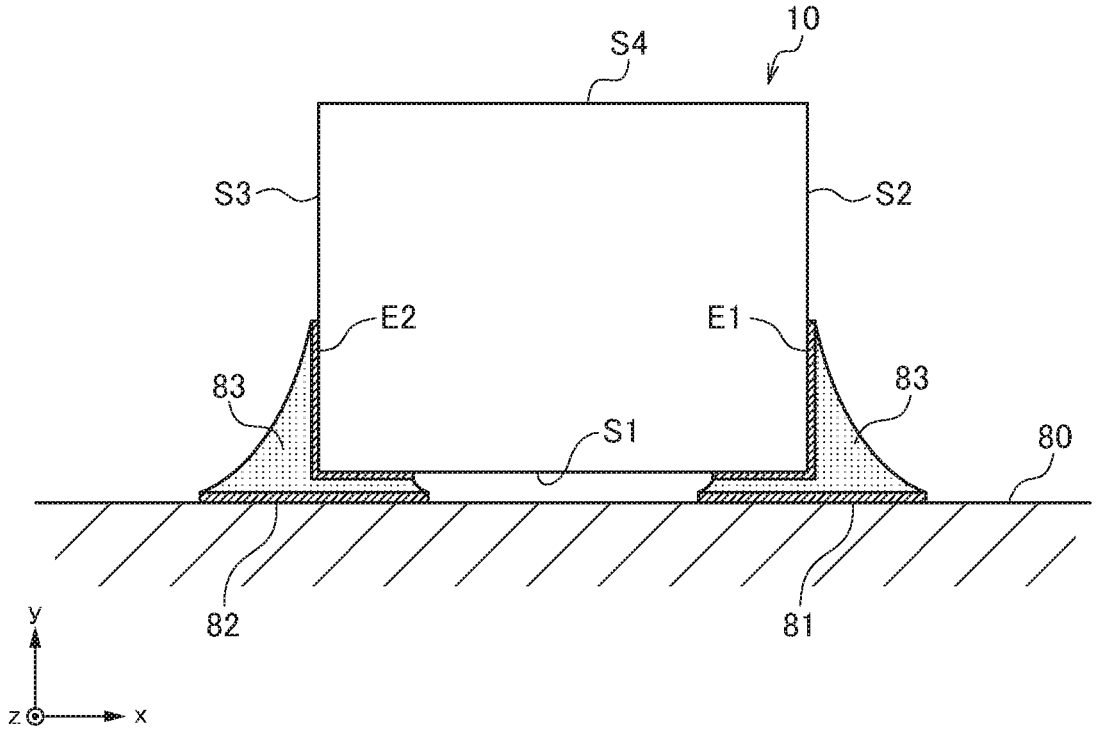
FIG. 3 is a side view illustrating a state where the coil component according to the embodiment of the present invention is mounted on a circuit board as viewed in the lamination direction.

FIG. 3 is a side view (as viewed from the lamination direction) illustrating a state where the coil component 10 according to the present embodiment is mounted on a circuit board 80.

As illustrated in FIG. 3, the coil component 10 according to the present embodiment is vertically mounted on the circuit board 80. Specifically, the coil component 10 is mounted such that the mounting surface S1 of the coil part 20 faces the mounting surface of the circuit board 80, that is, the z-direction that is the lamination direction of the coil component 10 is parallel to the mounting surface of the circuit board 80.

Land patterns 81 and 82 are provided on the circuit board 80, and the external terminals E1 and E2 of the coil component 10 are connected respectively to the land pattern 81 and 82. Electrical/mechanical connection between the land patterns 81, 82 and the external terminals E1, E2 is achieved by a solder 83. Fillet of the solder 83 is formed on apart of the external terminals E1 and E2 that are formed on the side surface S2 or S3 of the coil part 20.

When the coil component 10 is mounted on the circuit board 80 in practice, the positions of the respective external terminals E1 and E2 are specified by image recognition of the direction mark M formed on the upper surface S4 of the coil component 10. Thus, formation of the direction mark M on the upper surface S4 of the coil component 10 according to the present embodiment facilitates the image recognition.

Figure 4:
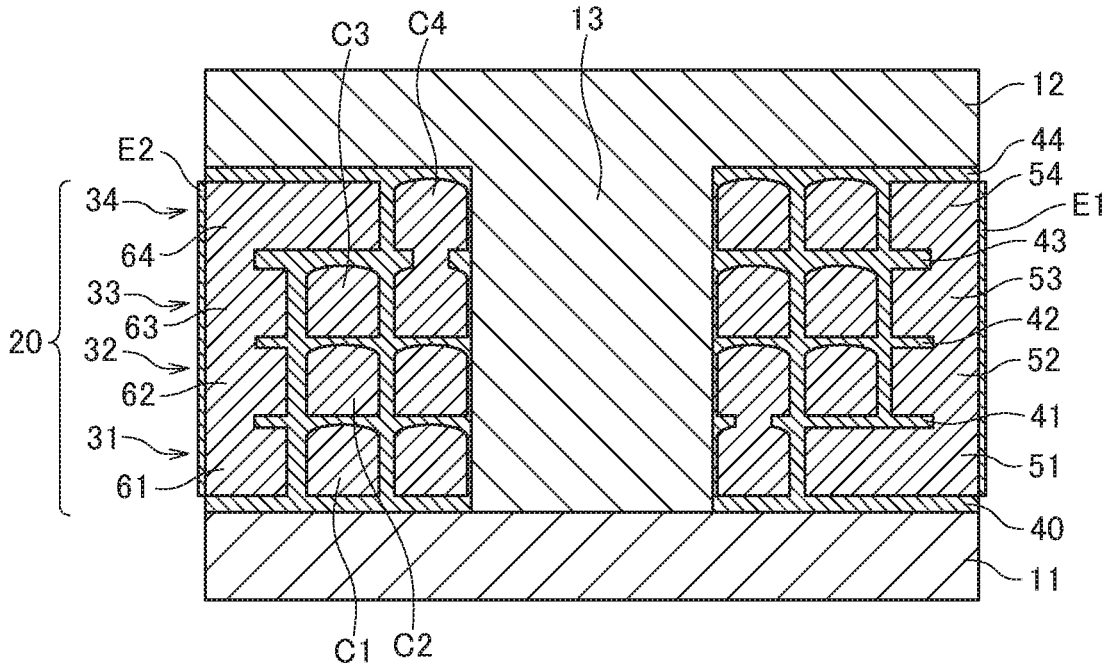
FIG. 4 is a cross-sectional view of the coil component according to the embodiment of the present invention.

FIG. 4 is a cross-sectional view of the coil component 10 according to the present embodiment.

As illustrated in FIG. 4, the coil part 20 included in the coil component 10 is sandwiched between the two magnetic layers 11 and 12 and has a configuration in which the interlayer insulating layers 40 to 44 and the conductor layers 31 to 34 are alternately laminated. The conductor layers 31 to 34 are connected to each other through through holes formed respectively in the interlayer insulating layers 41 to 43 to constitute a coil. The magnetic member 13 made of the same material as that of the magnetic layer 12 is embedded in the inner diameter portion of the coil. The interlayer insulating layers 40 to 44 are each made of, e.g., resin, and a non-magnetic material is used at least for the interlayer insulating layers 41 to 43. A magnetic material may be used for the interlayer insulating layers 40 and 44 which are the lowermost and uppermost layers, respectively.

The conductor layer 31 is the first conductor layer formed on the upper surface of the magnetic layer 11 through the interlayer insulating layer 40. The conductor layer 31 includes a coil conductor pattern C1 wound spirally in two turns and two electrode patterns 51 and 61. The electrode pattern 51 is connected to one end of the coil conductor pattern C1, while the electrode pattern 61 is provided independently of the coil conductor pattern C1. The electrode pattern 51 is exposed from the coil part 20, and the external terminal E1 is formed on the surface thereof. The electrode pattern 61 is exposed from the coil part 20, and the external terminal E2 is formed on the surface thereof.

The conductor layer 32 is the second conductor layer formed on the upper surface of the conductor layer 31 through the interlayer insulating layer 41. The conductor layer 32 includes a coil conductor pattern C2 wound spirally in two turns and two electrode patterns 52 and 62. The electrode patterns 51 and 52 are provided independently of the coil conductor pattern C2. The electrode pattern 52 is exposed from the coil part 20, and the external terminal E1 is formed on the surface thereof. The electrode pattern 62 is exposed from the coil part 20, and the external terminal E2 is formed on the surface thereof.

The conductor layer 33 is the third conductor layer formed on the upper surface of the conductor layer 32 through the interlayer insulating layer 42. The conductor layer 33 includes a coil conductor pattern C3 wound spirally in two turns and two electrode patterns 53 and 63. The electrode patterns 53 and 63 are provided independently of the coil conductor pattern C3. The electrode pattern 53 is exposed from the coil part 20, and the external terminal E1 is formed on the surface thereof. The electrode pattern 63 is exposed from the coil part 20, and the external terminal E2 is formed on the surface thereof.

The conductor layer 34 is the fourth conductor layer formed on the upper surface of the conductor layer 33 through the interlayer insulating layer 43. The conductor layer 34 includes a coil conductor pattern C4 wound spirally in two turns and two electrode patterns 54 and 64. The electrode pattern 64 is connected to one end of the coil conductor pattern C4, while the electrode pattern 54 is provided independently of the coil conductor pattern C4. The electrode pattern 54 is exposed from the coil part 20, and the external terminal E1 is formed on the surface thereof. The electrode pattern 64 is exposed from the coil part 20, and the external terminal E2 is formed on the surface thereof.

The coil conductor patterns C1 and C2 are connected to each other through a via conductor penetrating the interlayer insulating layer 41, coil conductor patterns C2 and C3 are connected to each other through a via conductor penetrating the interlayer insulating layer 42, and the coil conductor patterns C3 and C4 are connected to each other through a via conductor penetrating the interlayer insulating layer 43. Thus, an eight-turn coil is obtained by the coil conductor patterns C1 to C4. One end of the obtained eight-turn coil is connected to the external terminal E1, and the other end thereof is connected to the external terminal E2.

The electrode patterns 51 to 54 are connected to each other through a via conductor penetrating the interlayer insulating layers 41 to 43. Similarly, the electrode patterns 61 to 64 are connected to each other through a via conductor penetrating the interlayer insulating layers 41 to 43. The via conductors are exposed from the coil part 20, and the external terminals E1 and E2 are formed respectively on the surfaces thereof.

Although not appearing on the cross section illustrated in FIG. 4, direction mark patterns are further formed in the conductor layers 32 and 33. The direction mark patterns are exposed from the upper surface S4 of the coil part 20, and the direction marks M2 and M3 illustrated in FIG. 1 are formed respectively on the surfaces thereof.

The following describes the manufacturing method for the coil component 10 according to the present embodiment.

FIGS. 5A to 5F and 6A to 6D are process views for explaining the manufacturing processes of the coil component 10 according to the present embodiment. FIGS. 7A to 7H are plan views for explaining pattern shapes in respective processes.

Figure 5A:
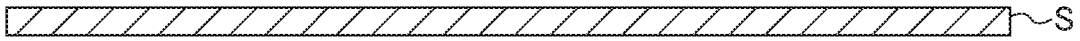
FIGS. 5A to 5F and 6A to 6D are process views for explaining the manufacturing processes of the coil component according to the embodiment of the present invention.
Figure 5B:
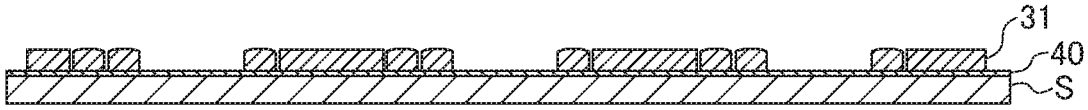

As illustrated in FIG. 5A, a support substrate S having predetermined strength is prepared, and a resin material is applied on the upper surface of the support substrate S by a spin coating method, whereby the interlayer insulating layer 40 is formed. Then, as illustrated in FIG. 5B, the conductor layer 31 is formed on the upper surface of the interlayer insulating layer 40. Preferably, as the formation method for the conductor layer 31, a base metal film is formed using a thin-film formation process such as sputtering, and then the resulting base metal film is grown by plating to a desired film thickness using an electroplating method. The conductor layers 32 to 34 to be formed subsequently are formed in the same manner.

Figures 7A, 7B, 7C, 7D:
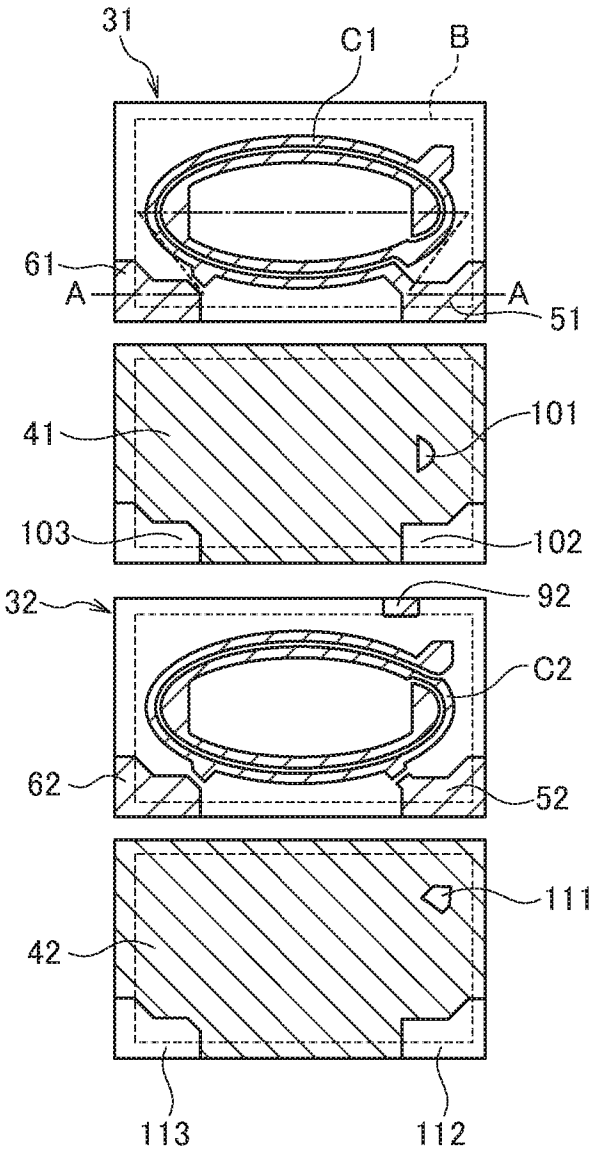
FIGS. 7A to 7H are plan views for explaining pattern shapes in respective processes.

The conductor layer 31 has a planar shape as illustrated in FIG. 7A and includes the coil conductor pattern C1 wound spirally in two turns and two electrode patterns 51 and 61. The line A-A illustrated in FIG. 7A denotes the cross-section position of FIG. 4, and the reference symbol B denotes the final product region of the coil component 10. The electrode patterns 51 and 61 are formed at positions overlapping the edge of a product region of the coil component 10.

Then, as illustrated in FIG. 7B, the interlayer insulating layer 41 that covers the conductor layer 31 is formed. Preferably, the interlayer insulating layer 41 is formed by applying a resin material using a spin coating method, followed by patterning by photolithography method. The interlayer insulating layers 42 to 44 to be formed subsequently are formed in the same manner. The interlayer insulating layer 41 has through holes 101 to 103 through which the conductor layer 31 is exposed. The through hole 101 is formed at a position through which the inner peripheral end of the coil conductor pattern C1 is exposed, the through hole 102 is formed at a position through which the electrode pattern 51 is exposed, and the through hole 103 is formed at a position through which the electrode pattern 61 is exposed.

Figure 5C:
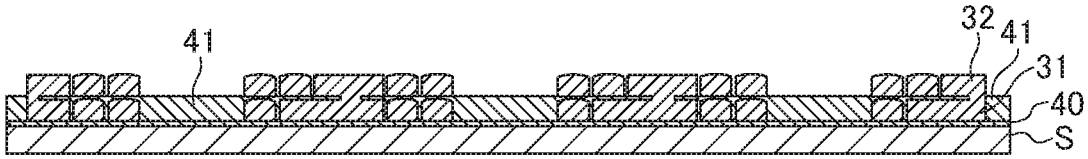

Then, as illustrated in FIG. 5C, the conductor layer 32 is formed on the upper surface of the interlayer insulating layer 41. The conductor layer 32 has a planar shape as illustrated in FIG. 7C and includes the coil conductor pattern C2 wound spirally in two turns, two electrode patterns 52 and 62, and a direction mark pattern 92. The direction mark pattern 92 is formed independently of other conductor patterns. As a result, the inner peripheral end of the coil conductor pattern C2 is connected to the inner peripheral end of the coil conductor pattern C1 through the through hole 101. The electrode pattern 52 is connected to the electrode pattern 51 through the through hole 102, and the electrode pattern 62 is connected to the electrode pattern 61 through the through hole 103. The electrode patterns 52 and 62 and the direction mark pattern 92 are formed at positions overlapping the edge of a product region of the coil component 10.

Then, as illustrated in FIG. 7D, the interlayer insulating layer 42 that covers the conductor layer 32 is formed. The interlayer insulating layer 42 has through holes 111 to 113 through which the conductor layer 32 is exposed. The through hole 111 is formed at a position through which the outer peripheral end of the coil conductor pattern C2 is exposed, the through hole 112 is formed at a position through which the electrode pattern 52 is exposed, and the through hole 113 is formed at a position through which the electrode pattern 62 is exposed.

Figure 5D:
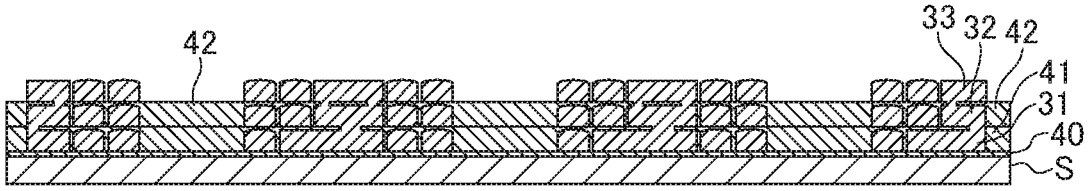
Figures 7E, 7F, 7G, 7H:
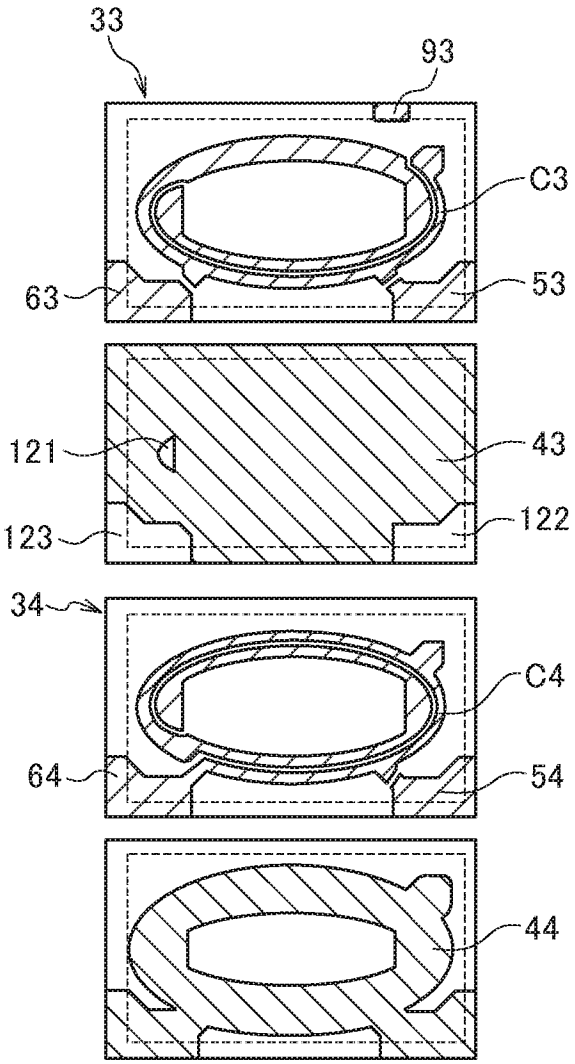

Then, as illustrated in FIG. 5D, the conductor layer 33 is formed on the upper surface of the interlayer insulating layer 42. The conductor layer 33 has a planar shape as illustrated in FIG. 7E and includes the coil conductor pattern C3 wound spirally in two turns, two electrode patterns 53 and 63, and a direction mark pattern 93. The direction mark pattern 93 is formed independently of other conductor patterns. As a result, the outer peripheral end of the coil conductor pattern C3 is connected to the outer peripheral end of the coil conductor pattern C2 through the through hole 111. The electrode pattern 53 is connected to the electrode pattern 52 through the through hole 112, and the electrode pattern 63 is connected to the electrode pattern 62 through the through hole 113. The electrode patterns 53 and 63 and the direction mark pattern 93 are formed at positions overlapping the edge of a product region of the coil component 10.

Then, as illustrated in FIG. 7F, the interlayer insulating layer 43 that covers the conductor layer 33 is formed. The interlayer insulating layer 43 has through holes 121 to 123 through which the conductor layer 33 is exposed. The through hole 121 is formed at a position through which the inner peripheral end of the coil conductor pattern C3 is exposed, the through hole 122 is formed at a position through which the electrode pattern 53 is exposed, and the through hole 123 is formed at a position through which the electrode pattern 63 is exposed.

Figure 5E:
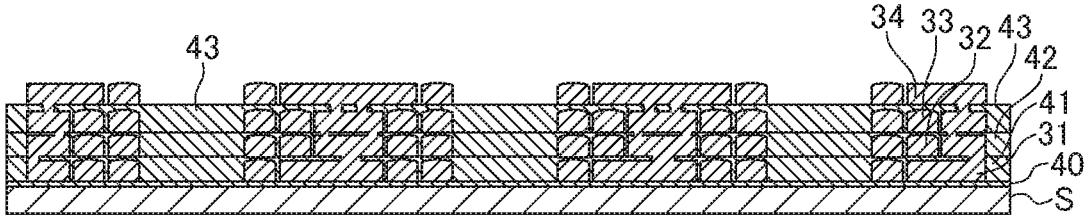

Then, as illustrated in FIG. 5E, the conductor layer 34 is formed on the upper surface of the interlayer insulating layer 43. The conductor layer 34 has a planar shape as illustrated in FIG. 7G and includes the coil conductor pattern C4 wound spirally in two turns and two electrode patterns 54 and 64. As a result, the inner peripheral end of the coil conductor pattern C4 is connected to the inner peripheral end of the coil conductor pattern C3 through the through hole 121. The electrode pattern 54 is connected to the electrode pattern 53 through the through hole 122, and the electrode pattern 64 is connected to the electrode pattern 63 through the through hole 123. The electrode patterns 54 and 64 are formed at positions overlapping the edge of a product region of the coil component 10.

Figure 5F:
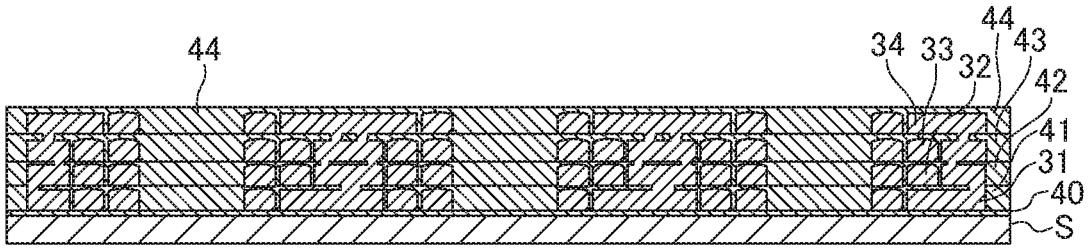

Then, as illustrated in FIG. 5F, the interlayer insulating layer 44 that covers the conductor layer 34 is formed on the entire surface and is then patterned as illustrated in FIG. 7H. As a result, the coil conductor pattern C4 and electrode patterns 54 and 64 are covered by the interlayer insulating layer 44, and the remaining region is exposed.

Figure 6A:
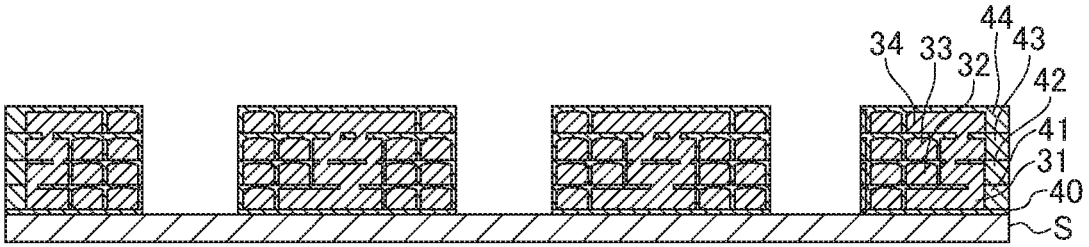

Then, as illustrated in FIG. 6A, dry etching or ion milling is performed using the patterned interlayer insulating layer 44 as a mask. As a result, a part of each of the interlayer insulating layers 40 to 43 that is not covered by the mask is removed, and a space is formed in the inner diameter region surrounded by the coil conductor patterns C1 to C4 and the coil external region positioned outside the coil conductor patterns C1 to C4.

Figure 6B:
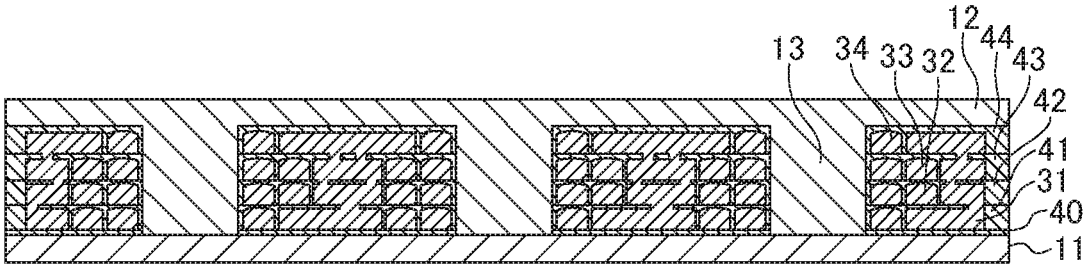

Then, as illustrated in FIG. 6B, a resin composite material containing ferrite powder or metal magnetic powder is embedded in the space formed by the removal of the interlayer insulating layers 40 to 43. As a result, the magnetic layer 12 is formed above the coil conductor patterns C1 to C4, and the magnetic member 13 is formed in the inner diameter region surrounded by the coil conductor patterns C1 to C4 and the coil external region positioned outside the coil conductor patterns C1 to C4. After that, the support substrate S is peeled off, and the composite material is formed on the lower surface side of the coil conductor patterns C1 to C4 to form the magnetic layer 11.

Figure 6C:
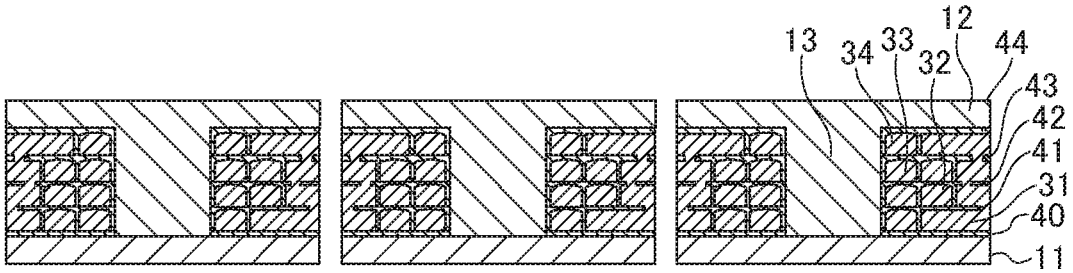
Figure 6D:
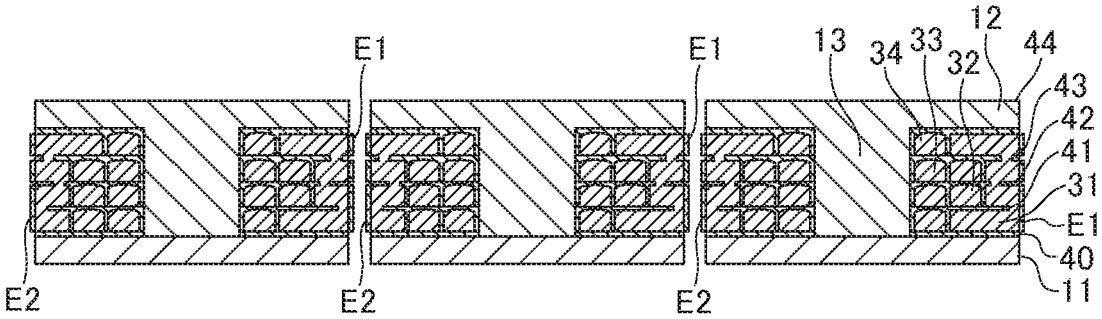

Then, as illustrated in FIG. 6C, dicing is performed for separation into individual semiconductor chips. As a result, the electrode patterns 51 to 54 and 61 to 64 and the direction mark pattern 92 and 93 are partially exposed from the dicing surface. When barrel plating is performed in this state, the external terminals E1 is formed on the exposed surface of the electrode patterns 51 to 54, the external terminals E2 is formed on the exposed surface of the electrode patterns 61 to 64, and the direction mark M2 and M3 are formed on the exposed surface of the direction mark pattern 92 and 93, respectively, as illustrated in FIG. 6D.

Thus, the coil component 10 according to the present embodiment is accomplished.

As described above, in the present embodiment, the conductor layers 32 and 33 have the direction mark patterns 92 and 93, respectively. When dicing is performed for separation into individual semiconductor chips, the surfaces of the direction mark patterns 92 and 93 are exposed on the upper surface S4. Thus, by performing barrel plating for formation of the external terminals E1 and E2, the direction mark M can be formed simultaneously with the formation of the external terminals E1 and E2. That is, the direction mark M can be formed without involving an increase in the number of processes. Since the coil component 10 according to the present embodiment is vertically mounted such that the z-direction that is the lamination direction is parallel to the circuit board, the image of the direction mark M can easily be recognized from above.

Figure 8A:
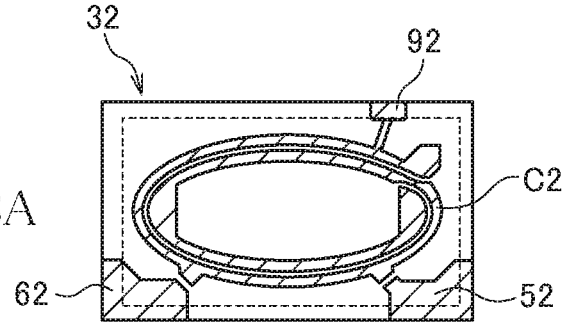
FIGS. 8A and 8B are plan views for explaining pattern shapes of modifications of the conductor layers.
Figure 8B:
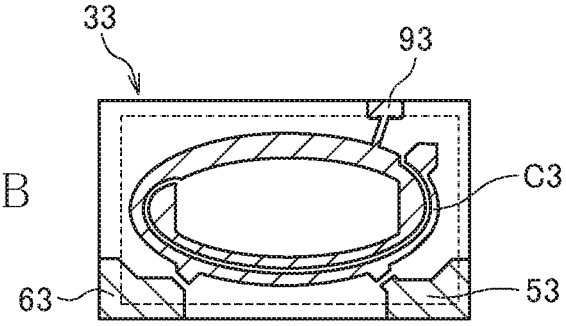

Further, as described above, the direction mark patterns 92 and 93 are formed independently of other conductor patterns, so that the direction mark M and the coil are insulated from each other. This prevents a faulty short circuit through the direction mark M from occurring after mounting. However, in the present embodiment, the direction mark pattern need not necessarily be formed independently of other conductor patterns, and may be electrically connected to, e.g., the coil conductor pattern. This makes it easier to form plating on the direction mark pattern, thus facilitating the formation of the direction mark M. FIG. 8A illustrates an example in which the direction mark pattern 92 and the coil conductor pattern C2 are connected to each other, and FIG. 8B illustrates an example in which the direction mark pattern 93 and the coil conductor pattern C3 are connected to each other.

FIGS. 9 to 13 are top views illustrating variations of the direction mark M.

Figure 9:
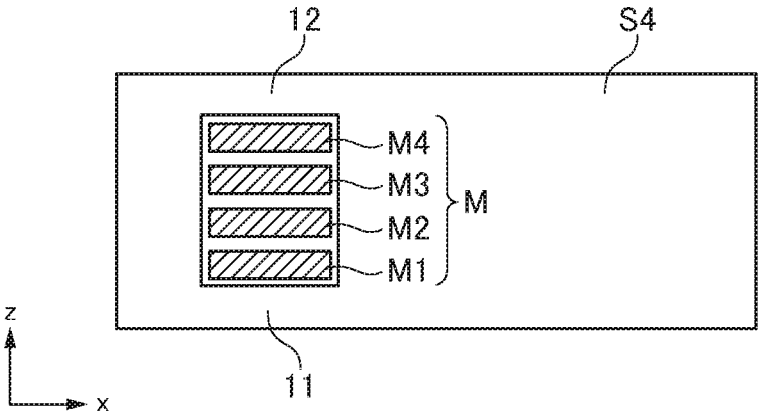
FIGS. 9 to 13 are plan views indicating variations of the direction marks.

FIG. 9 illustrates an example in which the direction mark M is constituted of direction marks M1 to M4 corresponding respectively to the conductor layers 31 to 34. Such a configuration can be obtained by forming the direction mark pattern in every one of the conductor layers 31 to 34. As described above, the direction mark corresponding to all the conductor layers may be formed.

Figure 10:
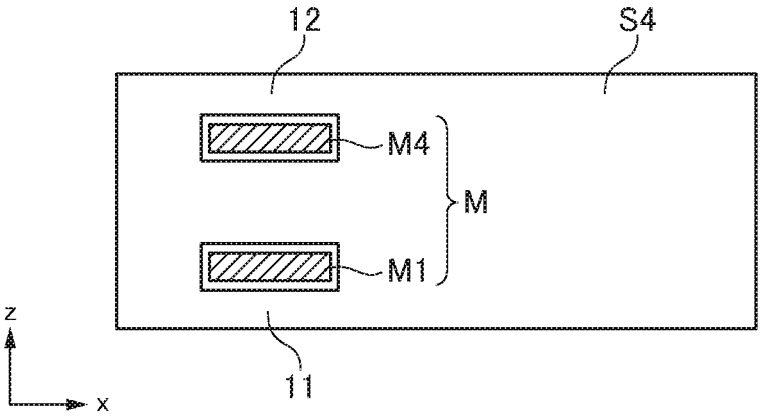

FIG. 10 illustrates an example in which the direction mark M is constituted of direction marks M1 and M4 corresponding respectively to the conductor layers 31 and 34. Such a configuration can be obtained by forming the direction mark pattern in the conductor layers 31 and 34. As described above, the direction mark corresponding to the conductor layers not adjacent to each other may be formed.

Figure 11:
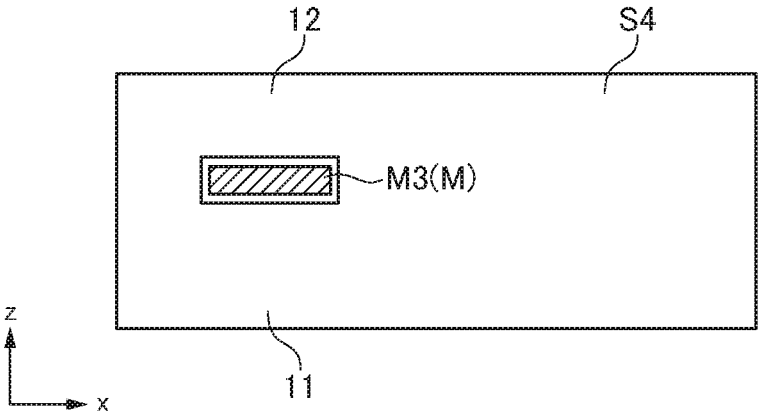

FIG. 11 illustrates an example in which the direction mark M is constituted of the direction mark M3 corresponding to the conductor layer 33. Such a configuration can be obtained by forming the direction mark pattern only in the conductor layer 33. As described above, the direction mark corresponding to a single conductor layer may be formed.

Figure 12:
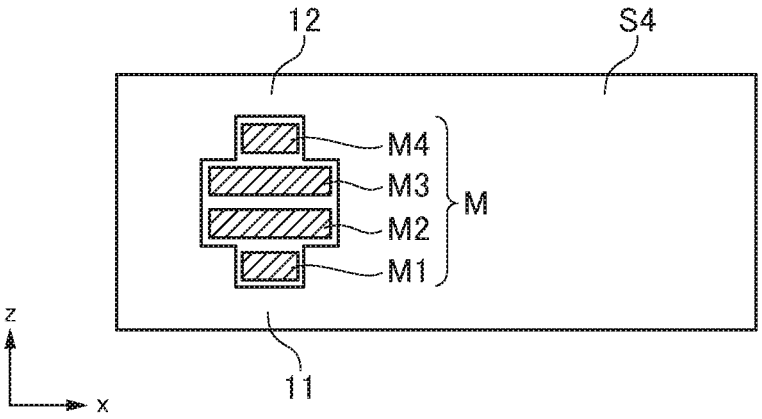

FIG. 12 illustrates an example in which the size of the direction marks M1 and M4 corresponding respectively to the conductor layers 31 and 34 and the size of the direction marks M2 and M3 corresponding respectively to the conductor layers 32 and 33 are made different from each other. Such a configuration can be obtained by differentiating the exposed area of the direction mark patterns formed respectively in the conductor layers 31 and 34 from the exposed area of the direction mark patterns formed respectively in the conductor layers 32 and 33. As described above, the direction marks having different sizes may be combined.

Figure 13:
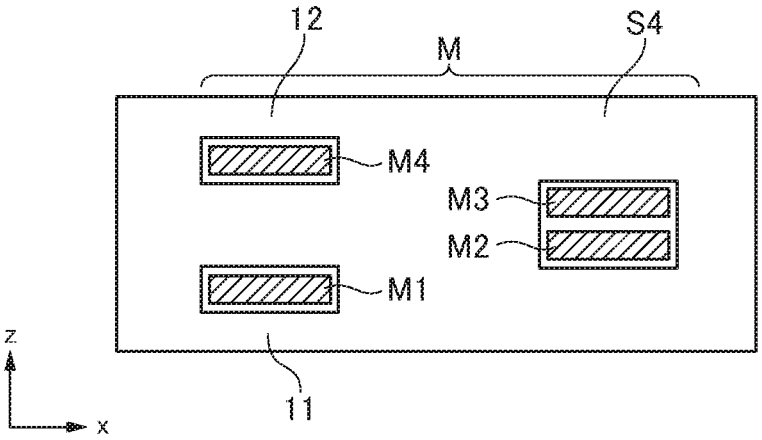

FIG. 13 illustrates an example in which the x-direction positions of the direction marks M1 and M4 corresponding respectively to the conductor layers 31 and 34 and the x-direction positions of the direction marks M2 and M3 corresponding respectively to the conductor layers 32 and 33 are made different from each other. That is, the direction marks M1 and M4 are formed on the external terminal E1 side, while the direction marks M2 and M3 are formed on the external terminal E2 side. Such a configuration can be obtained by differentiating the exposed position of the direction mark patterns formed respectively in the conductor layers 31 and 34 from the exposed position of the direction mark patterns formed respectively in the conductor layers 32 and 33. As described above, the direction marks different in the x-direction position may be combined.

It is apparent that the present invention is not limited to the above embodiments, but may be modified and changed without departing from the scope and spirit of the invention.

For example, in the above embodiment, the coil part 20 includes four conductor layers 31 to 34. However, in the present invention, the number of the conductor layers is not limited to this. Further, the number of turns of the coil conductor pattern formed in each conductor layer is not particularly limited.

What is claimed is:

1. A coil component comprising:

a coil part in which a plurality of conductor layers and a plurality of interlayer insulating layers are alternately laminated in a lamination direction, the coil part having a mounting surface substantially parallel to the lamination direction and an upper surface substantially parallel to the lamination direction and positioned on an opposite side to the mounting surface; and a direction mark comprising a conductive material that covers a part of the conductor layers exposed on the upper surface, wherein the plurality of conductor layers include first and second conductor layers, wherein the plurality of interlayer insulating layers include a first interlayer insulating layer positioned between the first and second conductor layers, wherein the direction mark includes a first direction mark comprising a conductive material that covers a part of the first conductor layer and a second direction mark comprising a conductive material that covers a part of the second conductor layer, and wherein the first and second direction marks are divided by the first interlayer insulating layer.

2. The coil component as claimed in claim 1, further comprising first and second external terminals that each cover another part of the conductor layers, wherein the first and second external terminals are connected respectively to one end and other end of a coil composed of the plurality of conductor layers, and wherein that the direction mark and the first and second external terminals are made of a same conductive material.

3. The coil component as claimed in claim 2, wherein the direction mark and the coil are insulated from each other.

4. The coil component as claimed in claim 2, wherein the direction mark and the coil are electrically connected to each other.

5. The coil component as claimed in claim 1, further comprising first and second magnetic layers disposed so as to sandwich the coil part in the lamination direction.

6. The coil component as claimed in claim 1, wherein the first and second direction marks are located adjacent to each other in the lamination direction.

7. The coil component as claimed in claim 1, wherein the first and second direction marks are located apart from each other in a direction perpendicular to the lamination direction from each other.

8. The coil component as claimed in claim 1, wherein the first and second direction marks are different in length in a direction perpendicular to the lamination direction from each other.

9. The coil component as claimed in claim 1, wherein the plurality of conductor layers further include a third conductor layer, wherein the plurality of interlayer insulating layers further include a second interlayer insulating layer positioned between the second and third conductor layers, wherein the direction mark further includes a third direction mark comprising a conductive material that covers a part of the third conductor layer, and wherein the second and third direction marks are divided by the second interlayer insulating layer.

10. The coil component as claimed in claim 9, wherein the plurality of conductor layers further include a fourth conductor layer, wherein the plurality of interlayer insulating layers further include a third interlayer insulating layer positioned between the third and fourth conductor layers, wherein the direction mark further includes a fourth direction mark comprising a conductive material that covers a part of the fourth conductor layer, and wherein the third and fourth direction marks are divided by the third interlayer insulating layer.

11. The coil component as claimed in claim 1, wherein the plurality of conductor layers further include a third conductor layer positioned between the first and second conductor layers, wherein the first interlayer insulating layer is positioned between the first and third conductor layers, wherein the plurality of interlayer insulating layers further include a second interlayer insulating layer positioned between the second and third conductor layers, and wherein the third conductor layer is free from the direction mark.

12. A coil component comprising:

a first interlayer insulating layer;

a first conductor layer formed on the first interlayer insulating layer;

a second interlayer insulating formed on the first conductor layer so as to embed the first conductor layer therein;

a second conductor layer formed on the second interlayer insulating layer; and a third interlayer insulating formed on the second conductor layer so as to embed the second conductor layer therein, wherein the first conductor layer includes a first coil pattern, a first electrode patterns, and a first direction mark, wherein the second conductor layer includes a second coil pattern connected to the first coil pattern, a second electrode patterns connected to the first electrode pattern, and a second direction mark, wherein the coil component has a first outer surface and a second outer surface positioned opposite to the first outer surface, wherein the first electrode pattern is exposed on the first surface without being covered by the second interlayer insulating layer, wherein the second electrode pattern is exposed on the first surface without being covered by the third interlayer insulating layer, wherein the first direction mark is exposed on the second surface without being covered by the second interlayer insulating layer, wherein the second direction mark is exposed on the second surface without being covered by the third interlayer insulating layer, and wherein the first and second direction marks are divided on the second surface by the second interlayer insulating layer interposed therebetween.

13. The coil component as claimed in claim 12, wherein the first and second direction marks have a same size as each other.

14. The coil component as claimed in claim 12, wherein the first and second direction marks have a different size from each other.

15. The coil component as claimed in claim 12, wherein the first and second direction marks are connected to the first and second coil patterns, respectively.

16. The coil component as claimed in claim 12, further comprising:

a third conductor layer formed on the third interlayer insulating layer; and a fourth interlayer insulating formed on the third conductor layer so as to embed the third conductor layer therein, wherein the third conductor layer includes a third coil pattern connected to the second coil pattern, a third electrode patterns connected to the second electrode pattern, and a third direction mark, wherein the third electrode pattern is exposed on the first surface without being covered by the fourth interlayer insulating layer, wherein the third direction mark is exposed on the second surface without being covered by the fourth interlayer insulating layer, and wherein the second and third direction marks are divided on the second surface by the third interlayer insulating layer interposed therebetween.

* * * * *